US006517008B1

(12) United States Patent
Remington et al.

(10) Patent No.: US 6,517,008 B1
(45) Date of Patent: Feb. 11, 2003

(54) BOLTLESS ADJUSTABLE RAIL BRACE ASSEMBLY WITH EXTERNAL VERTICAL RESTRAINT

(75) Inventors: James A. Remington, Sheffield Lake, OH (US); Karl E. Axthelm, Chagrin Falls, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 0 days.

(21) Appl. No.: 09/941,531

(22) Filed: Aug. 29, 2001

(51) Int. Cl.[7] ..... E01B 9/60
(52) U.S. Cl. ..... 238/315; 238/336; 238/310
(58) Field of Search ..... 238/336, 310, 238/324, 325, 328, 327 A, 337, 349, 347, 292, 354, 361, 315

(56) References Cited

U.S. PATENT DOCUMENTS

| | | | | |
|---|---|---|---|---|
| 2,525,185 A | * | 10/1950 | Schulze | 238/292 |
| 2,557,494 A | * | 6/1951 | Asselin | 238/292 |
| 3,269,655 A | * | 8/1966 | Frey | 238/292 |
| 3,292,857 A | * | 12/1966 | Hughes | 238/22 |
| 3,358,927 A | | 12/1967 | Hein et al. | |
| 4,566,630 A | | 1/1986 | Keiper, Jr. | |
| 4,770,342 A | * | 9/1988 | Farrell et al. | 238/292 |
| 4,824,015 A | | 4/1989 | Farrell et al. | |
| 5,094,387 A | | 3/1992 | Rice et al. | |
| 5,104,041 A | | 4/1992 | Remington | |
| 5,651,499 A | | 7/1997 | Mihailoff et al. | |
| 6,308,897 B1 | * | 10/2001 | Remington et al. | 238/292 |

OTHER PUBLICATIONS

Cleveland Track Material, Inc., Topnotcher Adjustable Rail Brace, advertisement, undated.

* cited by examiner

*Primary Examiner*—S. Joseph Morano
*Assistant Examiner*—Frantz F. Jules
(74) *Attorney, Agent, or Firm*—Rankin, Hill, Porter & Clark LLP

(57) ABSTRACT

A rail brace assembly provides positive support for a stock rail mounted on a switch brace plate. The assembly includes a rail brace having a generally central opening that it is installed over a fixed clip housing attached to the brace plate. The clip housing accepts a resilient clip that secures the rail brace in position on the brace plate and against the stock rail. The resilient clip provides spring force directly to the rail brace in both a vertically downward direction and a lateral direction. The rail brace has a lug to prevent the clip from being removed from the clip housing due to vibration. The clip housing prevents the brace from moving laterally even if the clip breaks or becomes disengaged. The brace assembly includes a stop that is secured to the brace plate and a tapered wedge that is disposed between the stop and the rail brace. Upon driving the wedge longitudinally of the rail, lateral force is applied to the rail brace and the rail. The stop and the wedge employ a longitudinally extending tongue and groove to prevent relative vertical movement therebetween. The junction between the wedge and the rail brace is defined by mating convex-concave surfaces. A shear member such as a cotter pin prevents the wedge from being retracted once the wedge has been driven to a desired longitudinal position. Because the wedge cannot be moved inadvertently, lateral force will be applied continuously to the rail brace by the wedge.

20 Claims, 3 Drawing Sheets

BOLTLESS ADJUSTABLE RAIL BRACE ASSEMBLY WITH EXTERNAL VERTICAL RESTRAINT

BACKGROUND OF THE INVENTION

Rail braces and rail brace assemblies are common railroad trackwork components, their primary function is to prevent rail rollover. They are most commonly used on railroad switches where the stock rail is not spiked, clipped or otherwise restrained on the gage (inside) side base. It is customary then that stock rails be braced on the field side to prevent rail rollover since the lateral forces generated by the passing locomotive and railcar wheels are sufficient to easily cause the rail to roll outwardly from track center. This rolling ultimately would allow the wheel to drop from the rail head causing the train to derail. Rail braces also are used in various locations where lateral forces are present, such as heavy curves on grades and in mountainous areas.

The evolution of rail braces began with one-piece rigid rail braces which were simply spiked into position up against the stock rail. These one-piece braces usually were forged from steel plate and were not adjustable. They commonly became loose after the passage of the first few trains.

Adjustable rail brace assemblies became preferred as they provided a means of retightening over time. Various types of adjustable rail brace assemblies used bolts to provide the tightening action. A good example of an adjustable, bolted rail brace assembly is the TOPNOTCHER adjustable rail brace developed by Pettibone Mulliken Corporation and still commercially available from Cleveland Track Material, Inc. of Cleveland, Ohio. These bolted designs provided adequate performance, a means of securing them in position and the ability to retighten. However, they were made of several components, were relatively expensive, and were time-consuming to install. Most importantly, they required maintenance in terms of retightening the nuts which always came loose due to vibration under load.

As train frequencies, tonnages and train speeds increased dramatically, and as track time required for installation and maintenance of the track components became much more restricted, the need for an improved rail brace assembly became apparent and necessary. In the 1980's there was a general trend within the railroad industry to minimize the use of threaded fasteners due to limited track time and reduced track maintenance crews.

In response to these considerations, several different boltless adjustable rail brace assemblies have been developed and marketed. Most of these boltless brace assemblies use a resilient rail clip fastener to secure the components into position. The most popular assemblies provide improved performance for many applications but have inherent design drawbacks which limit their performance and which limit the types of locations and installations with which they can be used. These assemblies do not provide any positive vertical restraint (other than the toe load of the elastic fastener) to keep them secured tightly to the switch brace plate when subjected to any upward vertical force. Also, these assemblies cannot be adjusted easily to apply a desired lateral force to the stock rail. Yet additionally, installation of these assemblies is more difficult than desired.

With the advent of pre-assembled switch panels, concrete ties and automated track tamping, the limitations of the existing boltless rail brace designs are significant. The lifting action during loading and unloading of pre-assembled switch panels and the lifting action imparted during automated tamping, combined with the added weight of concrete ties, causes the brace assemblies to come loose and to be disengaged from the switch brace plates. This creates serious safety problems and new maintenance issues.

Despite the advances of recent boltless adjustable rail brace assemblies, there remains a need for a self-securing boltless rail brace assembly that provides positive vertical restraint. Preferably, any such rail brace assembly would be easy to manufacture, easy to assemble and disassemble, easy to apply any desired lateral force to the stock rail, and strong and reliable in operation.

SUMMARY OF THE INVENTION

In response to the foregoing concerns, the rail brace assembly of the present invention is adapted for use with a switch brace plate that supports a stock rail that extends along a longitudinal axis. The assembly according to the invention comprises a rail brace disposed adjacent the rail, the rail brace lying atop the brace plate, the rail brace having one or more rail-contacting walls, a wedge-contacting wall disposed opposite the rail-contacting walls, an upper wall, and an opening in the upper wall, the opening being located intermediate the rail-contacting surfaces and the wedge surface. The assembly includes a stop connected to the brace plate, the stop being spaced laterally from the rail. The brace plate is disposed between the stop and the rail. The stop has a wedge-contacting wall. A wedge is disposed between the stop and the rail brace, the wedge having a stop-contacting wall and a rail brace-contacting wall. When the wedge is moved longitudinally of the rail, it causes the rail brace and the stop to be moved relative to each other.

A clip housing having first and second ends is connected to the brace plate at a location between the rail and the wedge. The first end is connected to the brace plate and the second end extends through the opening in the upper wall. The second end has a bore extending therethrough. A resilient clip is provided to provide resistance to vertical and lateral movement of the rail brace. The clip has first and second legs that are joined by a laterally extending segment, a longitudinally extending segment, and a curved segment. The first leg being extends through the bore. Both the second leg and the longitudinally extending segment are in contact with the upper wall and thereby resist both vertical and lateral movement of the rail brace.

As will be discussed in detail hereafter, the invention provides solutions to the problems associated with prior devices. The various features and advantages of the invention will be apparent to those skilled in the art from a review of the accompanying specification, claims, and drawings.

DESCRIPTION OF THE PREFERRED EMBODIMENT

Figure 1:
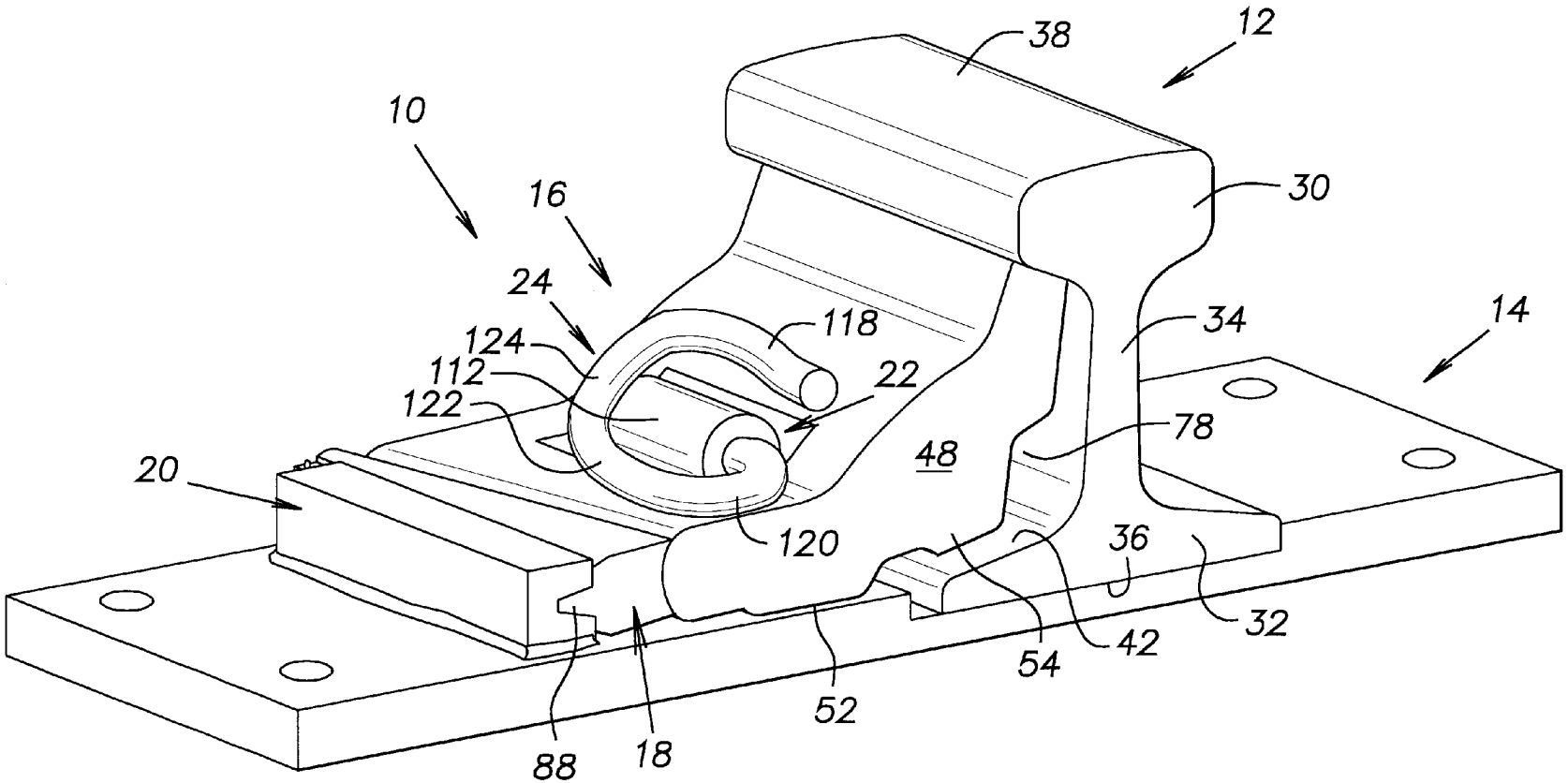
FIG. 1 is a perspective view of a rail brace assembly according to the invention showing the assembly as it is used in conjunction with a brace plate and a stock rail.

Referring to the FIGURES, a rail brace assembly according to the invention is indicated by the reference numeral 10.

The assembly 10 is intended to provide lateral or anti-rotational support for a stock rail 12 that is mounted to a brace plate 14. The assembly 10 includes a rail brace 16, a wedge 18, a stop 20, a clip housing 22, a resilient clip 24, and a shear member 26.

The stock rail 12 has three main components: a head 30, a base 32, and a web 34 that connects the head 30 and base 32. The base 32 has a flat bottom surface 36 that supports the rail 12 on the brace plate 14. The head 30 has a crowned upper surface 38 that provides the running contact surface for the wheel treads of the wheels of locomotives and railcars. The rail 12 also has a contact surface 40 on the underside of the head 30 and a contact surface 42 on the upper part of the base 34. The contact surfaces 40, 42 typically are used for fitting various track components such as castings, fillers, and joint bars.

For purposes of the present invention, the rail 12 will be considered to have a longitudinal axis 43 that extends along the length of the rail 12. The rail has a neutral axis coincident with the longitudinal axis 43. The neutral axis is defined as that vertical location of the rail 12 that bisects the rail 12 into upper and lower sections of equal cross-sectional area. For 136RE rail, which is the common standard for North American railroads, the neutral axis of the rail 12 is at a vertical location 3.347 inches above the bottom surface 36.

The brace plate 14 is an elongate, rectangular member having a seat 44 formed therein. The base 32 is fitted into the seat 44. The plate 14 also includes a plurality of openings 46 that enable the plate 14 to be mounted to various types of railroad ties (not shown).

Figure 3:
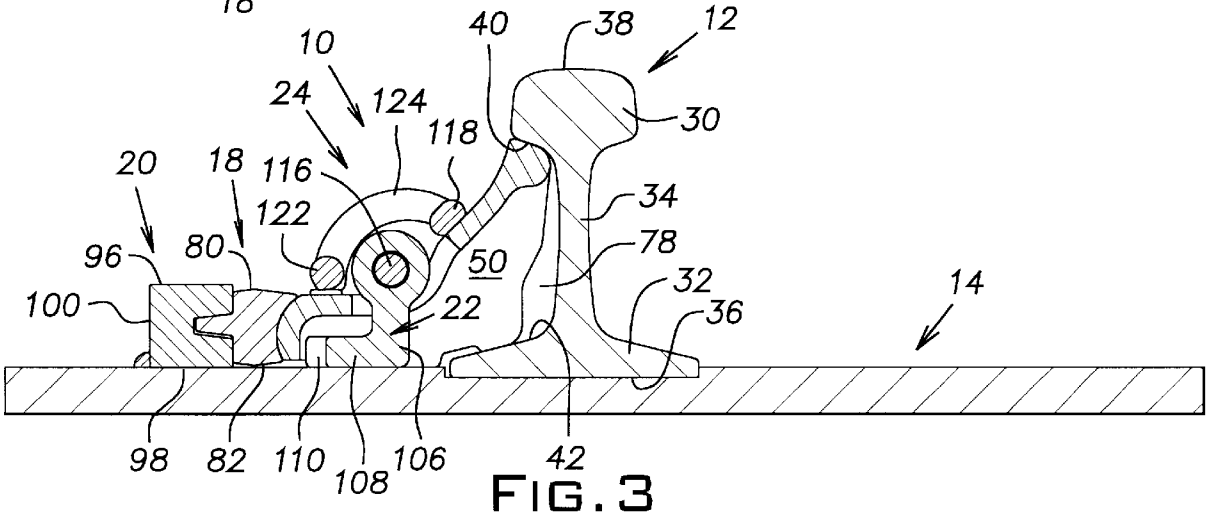
FIG. 3 is a cross-section view of the invention of FIG. 1 taken along a plane indicated by line 3—3 in FIG. 2.
Figure 4:
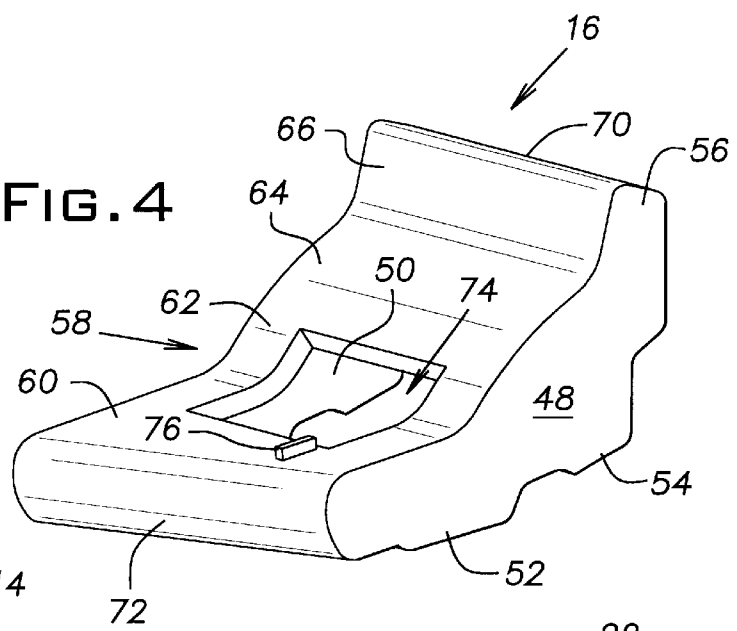
FIG. 4 is a perspective view of a rail brace included as part of the invention.

The rail brace 16 includes first and second generally parallel sidewalls 48, 50. Each sidewall 48, 50 has a first segment 52 that contacts the upper surface of the base plate 14, a second segment 54 that contacts the contact surface 42, and a third segment 56 that contacts the contact surface 40. The rail brace 16 has an upper wall 58 that includes a first, generally horizontal segment 60, and first, second, and third segments 62, 64, 66 that are inclined from the vertical. The intersection between adjacent segments 60, 62, 64, 66 is made with a smooth radius. An inclined wall 70 is formed at the upper portion of the upper wall 58 and the side walls 48, 50. The rail brace 16 also has a smooth, tapered, wedge-contacting wall 72, an opening 74 in the upper wall 58, and a lug 76 on the segment 60 of the upper wall 58. Referring particularly to FIGS. 1 and 3, the sidewalls 48, 50 define an opening or relief area 78 where the web 34 meets the base 32. The opening 78 provides clearance for the installation of rail-mounted heater units that are commonly used in the industry.

The wedge 18 is an elongate member that has upper and lower surfaces 80, 82, a smooth, concave, rail brace-contacting surface 84, and a smooth, flat, stop-contacting surface 86. A longitudinally extending tongue 88 projects from the stop-contacting surface 86. The wedge 18 is tapered longitudinally of its length such that it has a large end 90 and a small end 92. The taper is at a pre-determined angle of about 8.0 degrees relative to the longitudinal axis of the rail 12. In use, the stop-contacting surface 86 is parallel with the longitudinal axis 43 of the rail 12, while the brace-contacting surface is tapered along its length. A plurality of openings 94 are formed in the tongue 88 adjacent the small end 92.

The stop 20 has flat upper and lower surfaces 96, 98, a flat rear surface 100, and a smooth, flat, wedge-contacting surface 102. The surface 102 extends parallel with the longitudinal axis 43 of the rail 12. A longitudinally extending groove 104 extends the length of the surface 102. The groove 104 is of the same size and shape as the tongue 88. When the wedge 18 and the stop 20 are assembled, the surfaces 86, 102 are in substantial surface-to-surface contact and the tongue 88 is securely fitted within the groove 104. The stop 20 is welded to the brace plate 14.

Figure 6:
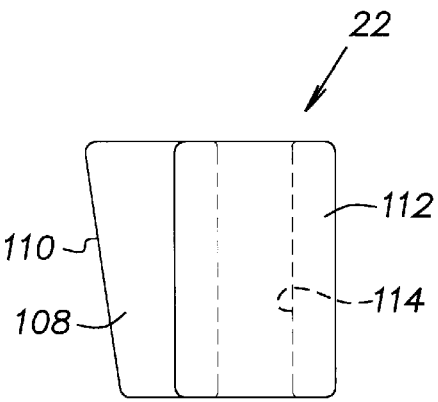
FIG 6 is a top plan view of the clip housing shown in FIG. 5.
Figure 5:
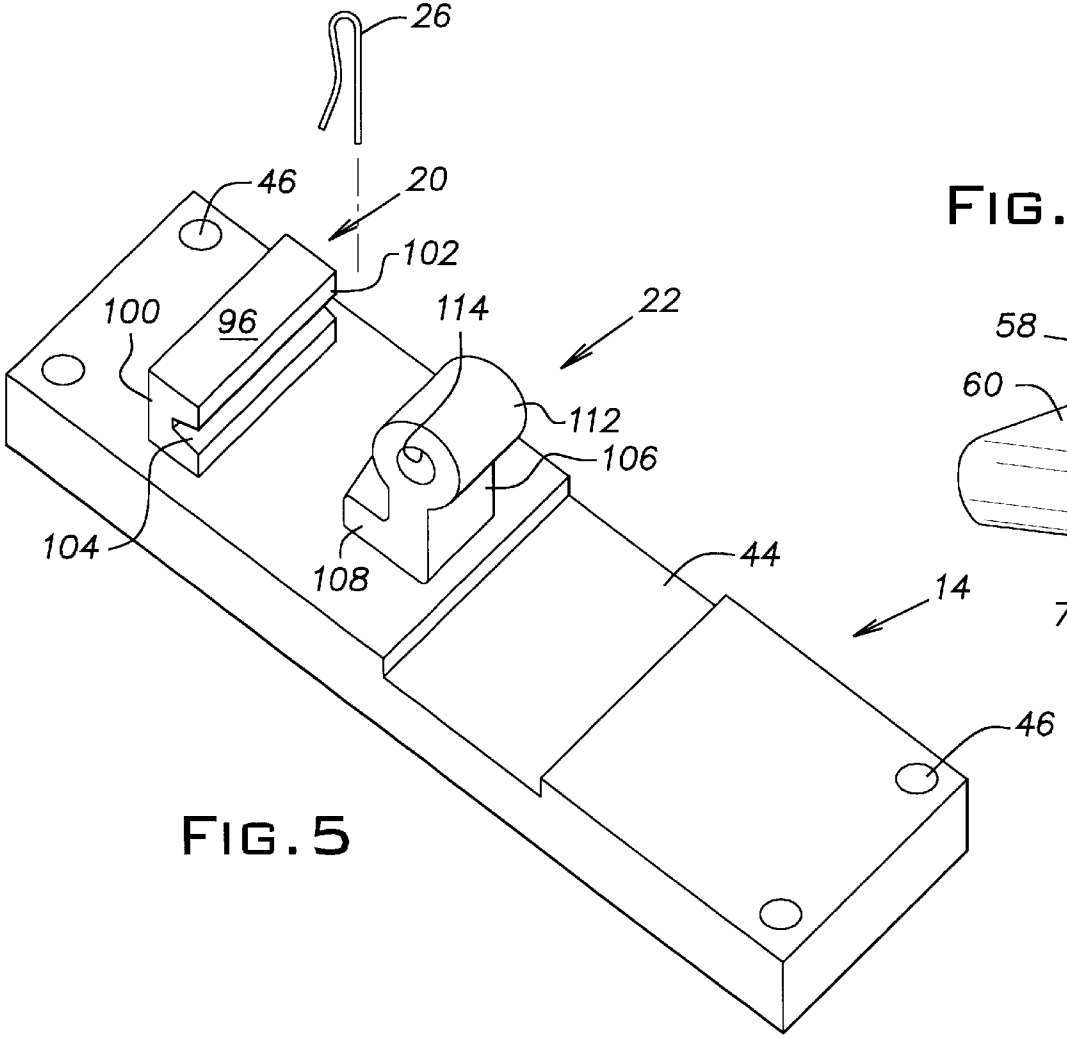
FIG. 5 is a perspective view of the brace plate with a stop and a clip housing attached thereto.

Referring particularly to FIGS. 3, 5, and 6, the clip housing 22 a vertical segment 106 from which a lower leg 108 projects. The leg 108 has an end face 110 that tapers along the longitudinal axis of the clip housing 22 at an angle that approximates the angle at which the wedge 18 and the wall 72 are tapered. The leg 108 is welded to the brace plate 14. The clip housing 22 includes an enlarged formation 112 at the upper end of the vertical segment 106. A longitudinally extending bore 114 extends through the formation 112. The length of the vertical segment 106 is such that the formation 112, in use, extends through the opening 74 such that the bottom portion of the bore 114 is approximately even with the horizontal segment 60.

Figure 2:
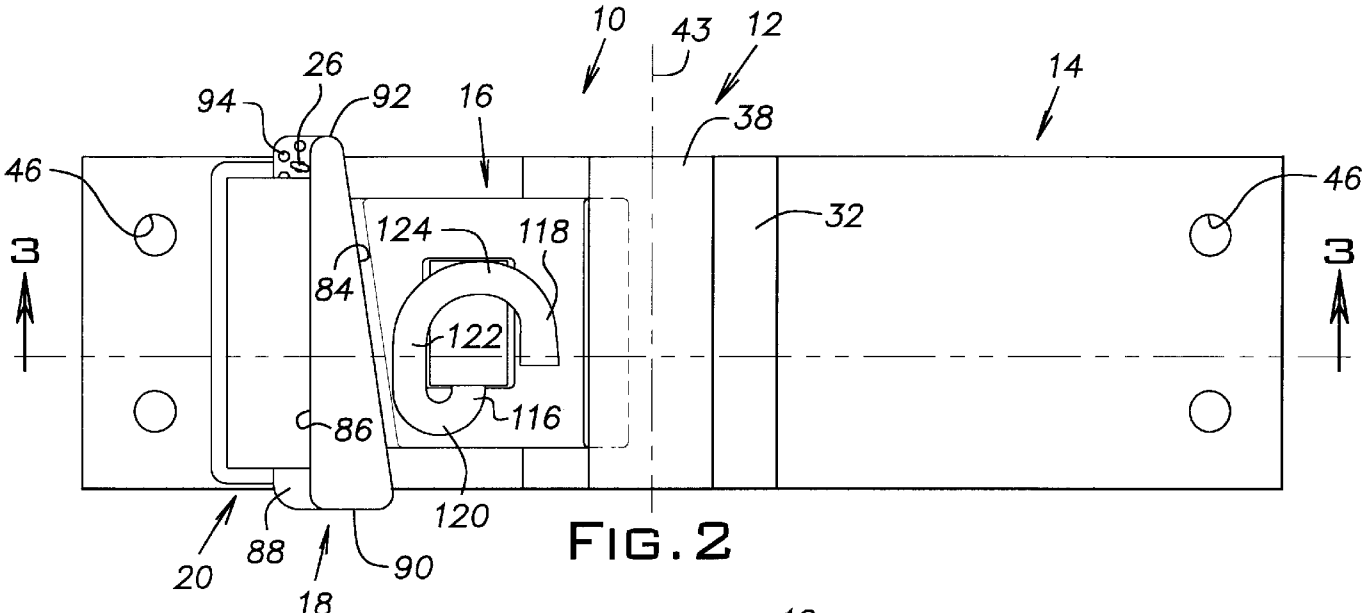
FIG. 2 is a top plan view of the invention of FIG. 1.

The resilient clip 24 includes first and second generally parallel legs 116, 118, a laterally extending segment 120 that is connected to one end of the first leg 116, a longitudinally extending segment 122 that is connected to the segment 120, and a curved segment 124 connects the segment 122 and the leg 118. The clip 24 is commercially available from Pandrol USA, LP, Bridgeport, N.J., under the trademark PANDROL. As will be apparent from an examination of FIGS. 1, 2, and 3, the first leg 116 is disposed in the bore 114, the segments 120, 122 are in contact with the horizontal surface 60, the curved segment 124 is spaced slightly above the upper wall 58, and the second leg 118 is in contact with the upper wall 58 in the region of the intersection of the first and second inclined segments 62, 64. In order to better resist rail rollover, the contact between the leg 118 and the upper wall 58 preferably occurs at a vertical location above the neutral axis of the rail 12.

The shear member 26 is of a size and shape to fit into one of the openings 94. Preferably the shear member 26 is a cotter pin, although other elongate members such as a hitch pin, bolt or nail could be used, if desired.

Operation

In use, the rail brace 16 is positioned onto the brace plate 14 such that the segment 52 contacts the plate 14 and the segments 54, 56 contact the contact surfaces 42, 40, respectively. Also, the inclined wall 70 contacts the contact surface 40. As noted previously, the formation 112 extends through the opening 74 in the upper wall 58.

The small end 92 of the wedge 18 is positioned to be driven into the open space between the stop 20 and the convex wedge-contacting wall 72. As the wedge 18 is driven into position by a suitable tool such as a sledge hammer, surface contact is created between the concave surface 84 of the wedge 18 and the convex wall 72 of the rail brace 16. In addition, surface contact is created between the two flat surfaces 86, 102 and the tongue 88 and the groove 104. After the wedge 18 has been driven longitudinally as far as desired, the position of the wedge 18 can be maintained by inserting the shear member 26 into the opening 94 closest to the end of the stop 20. The wedging action created by the all the mating surfaces described above drives the rail brace 16 tightly up against the stock rail 12. Contact surfaces 54, 56 and the inclined wall 70 of the rail brace 16 are tightly wedged against the corresponding surfaces 40 and 42 of the rail 12 to apply positive lateral force to the rail 12. As shown in FIGS. 1 and 3, the flange of the rail base 32 opposite the rail brace 16 is driven tightly against the side surface of the rail seat 44.

The resilient clip 24 now is installed with the first leg 116 inserted into the bore 114. As the leg 116 is fully inserted into the bore 114 (by being driven by a suitable tool such as a sledge hammer), the second leg 118 engages the second inclined segment 64 near the transition with the first inclined segment 62. The longitudinally extending segment 122 engages the horizontal segment 60. After the first leg 116 has been driven fully into the bore 114, the lug 76 engages the clip 24 and prevents the clip 24 from being removed from the clip housing 22. The force applied by the second leg 118 to the rail brace 16 has both a lateral component and a vertically downward component. The longitudinally extending segment 122 applies downward force to the horizontal segment 60. The upper first leg 116 applies a generally vertically upward force to the formation 112.

As will be apparent from an examination of the FIGURES and the foregoing description, the vertically downward force applied by the clip 24 will prevent the rail brace 16 from being displaced vertically when the rail 12 is attempted to be moved laterally or rotationally under load from a passing wheel. Because the second leg 118 contacts the inclined segment 64 at a vertical location above the neutral axis of the rail 12, the rail brace 16 provides improved resistance to rail rotation. Because the clip 24 is resilient, it will resist lateral or rotational movement of the rail 12 but will flex slightly under load. If the clip 24 inadvertently should break or become displaced, the clip housing 22 will resist lateral movement of the rail brace 16. The wedge 18, and the stop 20 provide excellent resistance to lateral forces delivered by the rail 12 through the rail brace 16. Because all mating surfaces of the rail brace 16, the wedge 18, and the stop 20 are smooth-sided, movement of the wedge 18 relative to the rail brace 16 and the stop 20 can occur easily during assembly. In turn, the amount of lateral force applied to the rail 12 can be controlled readily. The interaction of the shear member 26 and a selected one of the openings 94 enables the device to be assembled or disassembled without any special tools or equipment.

Although the invention has been disclosed in its preferred embodiment, it will be apparent to those skilled in the art that various changes and modifications can be made thereto without departing from the true spirit and scope of the invention as hereinafter claimed. Merely by way of example and not by way of limitation, it is possible to interchange the convex and concave surfaces 86, 102 or to interchange the tongue 88 and the groove 104. If the tongue 88 and the groove 104 are interchanged, the tongue 88 should extend beyond the large end 90 and the openings 94 should be located at the large end 90. It is intended that the patent shall cover, by suitable expression in the appended claims, all such changes and modifications.

What is claimed is:

1. A rail brace assembly adapted for use with a switch brace plate that supports a stock rail, the stock rail extending along a longitudinal axis, the assembly comprising:

a rail brace disposed adjacent the rail, the rail brace lying atop the brace plate, the rail brace having:

one or more rail-contacting surfaces;

a wedge-contacting wall disposed opposite the rail-contacting surfaces;

an upperwall; and an opening in the upper wall, the opening being located intermediate the rail-contacting surfaces and the wedge-contacting wall;

a stop connected to the brace plate, the stop being spaced laterally from the rail, the rail brace being disposed between the stop and the rail, the stop having a wedge-contacting wall;

a wedge disposed between the stop and the rail brace, the wedge having a stop-contacting wall and a rail brace-contacting wall, the wedge, when moved longitudinally of the rail, causing the rail brace and the stop to be moved away from or toward each other;

a clip housing having first and second ends, the first end connected to the brace plate and the second end extending through the opening in the upper wall, the second end having a bore extending therethrough; and a resilient clip having first and second legs, the first leg being extending through the bore and the second leg being in contact with the upper wall.

2. The rail brace assembly of claim 1, wherein the rail brace includes:

first and second side walls, the side walls being generally parallel with each other, each side wall having a first segment in contact with the brace plate, a second segment in contact with a lower portion of the rail, and a third segment in contact with an upper portion of the rail;

the upper wall extending between the first and second side walls;

an inclined wall in contact with the upper portion of the rail, the inclined wall extending between the side walls and forming an extension of the upper wall; and a wedge-contacting wall being disposed opposite the inclined wall, the wedge-contacting wall extending between the side walls and forming an extension of the upper wall.

3. The rail brace assembly of claim 1, wherein the upper wall includes:

a generally horizontal segment extending from the wedge-contacting wall;

a first inclined segment projecting upwardly from the generally horizontal segment;

a second inclined segment extending from the first inclined segment, a third inclined segment projecting upwardly from the second inclined segment, and the intersections between each of the adjacent segments being smoothly contoured.

4. The rail brace assembly of claim 3, wherein the opening in the upper wall is in the form of a generally rectangular window that opens through the generally horizontal segment and the first inclined segment.

5. The rail brace assembly of claim 1, wherein a selected one of the wedge-contacting wall or the rail brace-contacting wall is convex and the other of the wedge-contacting wall or the rail brace-contacting wall is concave, the convex and concave walls being configured so that they are in substantial surface-to-surface contact with each other.

6. The rail brace assembly of claim 5, wherein the wedge-contacting wall is convex and the rail brace-contacting wall is concave.

7. The rail brace assembly of claim 1, wherein a longitudinally extending groove is formed in a selected one of the wedge-contacting wall or the stop-contacting wall and a longitudinally extending tongue projects from the other of the wedge-contacting wall or the stop-contacting wall, the tongue being of a size and shape to fit snugly within the groove while permitting the wedge-contacting wall and the stop-contacting wall to engage each other in substantial surface-to-surface contact.

8. The rail brace assembly of claim 7, wherein the groove is formed in the stop and the tongue projects from the wedge.

9. The rail brace assembly of claim 7, wherein:

the wedge-contacting wall of the stop is parallel with the longitudinal axis of the rail;

the stop-contacting wall of the wedge is parallel with the longitudinal axis of the rail;

the rail brace-contacting wall of the wedge is smoothly tapered at a pre-determined angle relative to the longitudinal axis of the rail so that the wedge has a larger end and a smaller end; and the wedge-contacting wall of the rail brace is smoothly tapered at the pre-determined angle relative to the longitudinal axis of the rail.

10. The rail brace assembly of claim 9, wherein the pre-determined angle is about 8.0 degrees.

11. The rail brace assembly of claim 9, further comprising:

a plurality of longitudinally spaced openings in the tongue, the openings being located toward the smaller end of the wedge if the tongue projects from the wedge and at the larger end of the wedge if the tongue projects from the stop; and a shear member adapted to be disposed in a selected one of the openings when the wedge is tightly compressed between the stop and the rail brace, the shear member preventing the wedge from being moved relative to the stop.

12. The rail brace assembly of claim 11, wherein the shear member is a cotter pin.

13. The rail brace assembly of claim 1, wherein the first end of the clip housing is generally L-shaped with one leg extending generally vertically, and the bore in the second end extends longitudinally of the rail.

14. The rail brace assembly of claim 1, wherein;

the first and second legs of the resilient clip are generally parallel with each other;

a laterally extending segment extends from one end of the first leg;

a longitudinally extending segment extends from the laterally extending segment and is in contact with the upper wall; and a curved segment extends from the longitudinally extending segment and is connected to the second leg.

15. The rail brace assembly of claim 1, wherein the rail has a neutral axis located a pre-determined distance above the rail plate and the second leg of the clip contacts the upper wall of the rail brace at a vertical elevation above the neutral axis of the rail.

16. A rail brace assembly adapted for use with a switch brace plate that supports a stock rail, the stock rail extending along a longitudinal axis and having a neutral axis located a predetermined distance above the brace plate, the assembly comprising:

a rail brace disposed adjacent the rail, the rail brace lying atop the brace plate, the rail brace having:

first and second side walls, the side walls being generally parallel with each other, each side wall having a first segment in contact with the brace plate, a second segment in contact with a lower portion of the rail, and a third segment in contact with an upper portion of the rail;

an upper wall extending between the first and second side walls, the upper wall including:

a generally horizontal segment extending from the wedge-contacting wall;

a first inclined segment projecting upwardly from the generally horizontal segment;

a second inclined segment extending from the first inclined segment;

a third inclined segment projecting upwardly from the second inclined segment;

the intersections between each of the adjacent segments being smoothly contoured;

an inclined wall in contact with the upper portion of the rail, the inclined wall extending between the side walls and forming an extension of the upper wall;

a wedge-contacting wall opposite the inclined wall, the wedge-contacting wall extending between the side walls and forming an extension of the upper wall; and an opening in the upper wall, the opening being in the form of a generally rectangular window that opens through the generally horizontal segment and the first inclined segment;

a stop connected to the brace plate, the stop being spaced laterally from the rail, the rail brace being disposed between the stop and the rail;

a wedge disposed between the stop and the rail brace, the wedge, when moved longitudinally of the rail, causing the rail brace and the stop to be moved away from or toward each other, the wedge having a rail brace-contacting wall, the stop includes a wedge-contacting wall that faces the wedge and the wedge includes a stop-contacting wall, and a longitudinally extending groove is formed in a selected one of the wedge-contacting wall or the stop-contacting wall;

a longitudinally extending tongue projects from the other of the wedge-contacting wall or the stop-contacting wall, the tongue being of a size and shape to fit snugly within the groove while permitting the wedge-contacting wall and the stop-contacting wall to engage each other in substantial surface-to-surface contact;

a selected one of the wedge-contacting wall of the rail brace or the rail brace-contacting wall of the wedge being convex and the other of the wedge-contacting wall of the rail brace or the rail brace-contacting wall of the wedge being concave, the convex and concave walls being configured so that they are in substantial surface-to-surface contact with each other;

the wedge-contacting wall of the stop is parallel with the longitudinal axis of the rail;

the stop-contacting wall of the wedge is parallel with the longitudinal axis of the rail;

the rail brace-contacting wall of the wedge is smoothly tapered at a pre-determined angle relative to the longitudinal axis of the rail so that the wedge has a larger end and a smaller end;

the wedge-contacting wall of the rail brace is smoothly tapered at the pre-determined angle relative to the longitudinal axis of the rail;

a plurality of longitudinally spaced openings in the tongue, the openings being located toward the smaller end of the wedge if the tongue projects from the wedge and at the larger end of the wedge if the tongue projects from the stop;

a shear member adapted to be disposed in a selected one of the openings when the wedge is tightly compressed between the stop and the rail brace, the shear member preventing the wedge from being moved relative to the stop;

a clip housing having first and second ends, the first end being generally L-shaped and connected to the brace plate and the second end extending through the opening in the upper wall, the second end having a longitudinally extending bore; and a resilient clip having:

first and second legs that are generally parallel with each other, the first leg being extending through the bore and the second leg being in contact with the upper wall at a vertical location above the neutral axis of the rail;

a laterally extending segment that extends from one end of the first leg, a longitudinally extending segment that extend segment that extends from the laterally extending segment and is in contact with the generally horizontal segment of the upper wall;

a curved segment that extends from the longitudinally extending segment and is connected to the second leg; and the second leg is in contact with the second inclined segment of the upper wall.

17. The rail brace assembly of claim 16, wherein the groove is formed in the stop and the tongue projects from the wedge.

18. The rail brace assembly of claim 16, wherein the wedge-contacting wall of the rail brace is convex and the rail brace-contacting wall of the wedge is concave.

19. The rail brace assembly of claim 16, wherein the pre-determined angle is about 8.0 degrees.

20. The rail brace assembly of claim 16, wherein the shear member is a cotter pin.

* * * * *

UNITED STATES PATENT AND TRADEMARK OFFICE

CERTIFICATE OF CORRECTION

PATENT NO. : 6,517,008 B1
DATED : February 11, 2003
INVENTOR(S) : Remington et al.

It is certified that error appears in the above-identified patent and that said Letters Patent is hereby corrected as shown below:

Column 5,
Line 60, “upperwall” should be two words, -- upper wall --.

Column 9,
Line 12, delete “extend segment that”

Signed and Sealed this

Eighth Day of July, 2003

JAMES E. ROGAN
*Director of the United States Patent and Trademark Office*